US005290226A

United States Patent [19]

Green, Jr.

[11] Patent Number: 5,290,226

[45] Date of Patent: Mar. 1, 1994

[54] METHOD OF AND APPARATUS FOR CUTTING A WEB AND FOLDING THE RESULTING RIBBONS

[75] Inventor: Robert L. Green, Jr., Hillsboro, Ohio

[73] Assignee: G. Fordyce Company, Inc., Hillsboro, Ohio

[21] Appl. No.: 995,697

[22] Filed: Dec. 23, 1992

[51] Int. Cl.[5] ..... B65H 21/00; B65H 45/101; B65H 20/28

[52] U.S. Cl. ..... 493/357; 493/413; 493/356

[58] Field of Search ..... 270/39, 52.5; 493/356, 493/357, 411, 412, 413, 414, 415

[56] References Cited

U.S. PATENT DOCUMENTS

| | | | |
|---|---|---|---|
| 1,112,288 | 9/1914 | Hildebrandt | 493/357 |
| 1,425,071 | 8/1922 | Winter | 493/411 X |
| 1,489,833 | 4/1924 | Keller | 270/39 X |
| 1,830,416 | 11/1931 | Wood | 493/357 |
| 1,849,958 | 3/1932 | Roesen | 493/357 |
| 2,098,427 | 11/1937 | Menschner . | |
| 3,083,010 | 3/1963 | Salmon et al. . | |
| 3,124,350 | 3/1964 | Huffman . | |
| 3,499,643 | 3/1970 | Biggar, Jr. . | |
| 3,889,940 | 6/1975 | Jakob . | |
| 3,912,252 | 10/1975 | Stephens . | |
| 4,045,012 | 8/1977 | Jakob . | |
| 4,151,985 | 5/1979 | Gladow . | |
| 4,277,058 | 7/1981 | Biggar, III . | |
| 4,332,581 | 6/1982 | Thompson . | |
| 4,401,428 | 8/1983 | Thomas et al. . | |
| 4,512,561 | 4/1985 | Ury . | |
| 4,597,748 | 7/1986 | Wolf | 493/413 X |
| 4,603,533 | 8/1986 | Musick | 493/357 X |
| 4,618,340 | 10/1986 | Meschi . | |
| 4,730,762 | 3/1988 | Felix . | |
| 5,084,000 | 1/1992 | Fordyce . | |
| 5,205,808 | 4/1993 | Gebhardt | 493/204 X |

FOREIGN PATENT DOCUMENTS

| | | | |
|---|---|---|---|
| 3213895 | 10/1983 | Fed. Rep. of Germany | 493/413 |
| 2312442 | 1/1977 | France . | |
| 58-104870 | 6/1983 | Japan | 493/412 |
| 894791 | 4/1962 | United Kingdom . | |
| 988080 | 4/1965 | United Kingdom . | |

*Primary Examiner*—Edward K. Look
*Assistant Examiner*—John Ryznic
*Attorney, Agent, or Firm*—Ruden, Barnett, McClosky, Smith, Schuster & Russel

[57] ABSTRACT

A zig-zag folding apparatus includes a slitter blade which forms one or more longitudinally extending slits completely through a comparatively wide web of paper thus forming two or more individual, narrower sections of paper. A spreader device, located downstream from the slitter blade, is effective to produce a longitudinally extending gap or space between the individual paper sections where the slits were formed, and these separated paper sections are each transferred to an individual folding mechanism to form individual stacks of zig-zag folded sheets.

25 Claims, 4 Drawing Sheets

METHOD OF AND APPARATUS FOR CUTTING A WEB AND FOLDING THE RESULTING RIBBONS

FIELD OF THE INVENTION

This invention relates to folding apparatus, and, more particularly, to a zig-zag folding apparatus for longitudinally cutting or slitting a web of paper to form two or more paper sections and then individually folding each of the sections of paper into separate zig-zag folded stacks.

BACKGROUND OF THE INVENTION

High speed printing machines have been developed in recent years for printing data on computer paper, business forms and the like. The paper supplied to such printers is provided in webs of indeterminate length formed with longitudinally spaced, transversely oriented perforations. The paper is fed at high speeds from the web to the printer which prints the desired information on the individual sheets formed between adjacent perforations, and then discharges the printed sheets for further handling. In order to convert the continuous length of paper from the printer into a form which can be handled and shipped, the paper must be folded along its perforations as it is discharged from the printer.

One type of folding apparatus intended for use with high speed printers is a spiral zig-zag folder. Spiral zig-zag folders include a series of rollers which receive the paper from the printer and guide it to a reciprocating swing chute mechanism. The swing chute is driven forwardly and rearwardly relative to the frame of the folder through a distance or throw which is proportional to the distance between the longitudinally spaced transverse perforations in the paper. At both the forward and rearward limit of the throw of the swing chute, a set of beaters or knock-down fingers engages the paper in the area of its perforations and forces it into contact with one or more rotating spirals. The spirals resemble a screw having threads which are spaced progressively closer to one another from top to bottom. The paper is forced by the knock-down fingers into the top portion of the spirals, where the threads are spaced furthest apart, and as the spirals rotate the paper is transferred to progressively narrower threads thus forming a fold or crease along a perforation between adjacent, individual sheets of the paper. The sheets are then discharged from the spirals forming a zig-zag folded stack.

In addition to operating at high speeds, present day printers are also capable of accommodating different webs of paper each having a different spacing between the transverse perforations, or a different width. While the majority of business forms and computer paper are 8½ inches in width, it is recognized that some forms must be narrower or wider depending upon the requirements of a particular customer. Additionally, it may be much more efficient to feed a web of wider paper through the printer, and then cut it in half or thirds prior to folding, instead of sending narrower webs of paper through the printer, one after the other, in order to obtain the desired quantity of business forms, computer sheets or the like.

Prior methods and apparatus of slitting and then stacking relatively wide webs of paper have a number of deficiencies. Such apparatus generally include a slitter mechanism located immediately downstream from the printer which forms one or more longitudinal slits extending partially through the paper web. The comparatively wide paper web is partially slit in half or in thirds, for example, thus forming two or more separable, longitudinally extending sections of paper. The partially slit paper web is then transferred to a folding apparatus of the type described above, e.g. including knock-down fingers and spirals, which zig-zag folds the paper into a single stack of individual sheets. Because the web of paper is only partially cut or slit longitudinally by the slitter, the operator must manually separate the single folded stack of individual sheets into two or more separate stacks, usually by moving his or her hand along each partially formed slit between the longitudinally extending sections of paper. This is not only a physically difficult hand operation which can injure the operator, but it also can produce ragged edges along the sides of each stacked section of paper where a slit is formed.

The reason prior art apparatus of the type described above do not completely cut or slit the wide paper web upstream from the folder is that difficulties have been encountered in handling, i.e. transferring and folding, two or more completely separated, relatively narrow sections of paper formed from the wider paper web. It has proven difficult to properly support and convey two or more separated sections of relatively narrow paper from the slitter to knock-down fingers and spirals, and such individual, narrow sections of paper tend to interfere with one another in the course of being folded. As a result, and as noted above, prior art methods and apparatus form only a partial slit in the wide web of paper so that the individual, longitudinally extending sections are not separated from one another in the course of being transferred from the slitter to the folding devices and/or during the folding operation itself. Although this facilitates the folding operation, the further step of separating the partially slit stacks from one another after folding remains a problem.

SUMMARY OF THE INVENTION

It is therefore among the objectives of this invention to provide a zig-zag folding apparatus which is capable of forming separate sections of longitudinally extending paper from a wide paper web, and, which transfers, folds and stacks each separate paper section individually without interference with one another.

These objectives are accomplished in a zig-zag folding apparatus comprising a cutter or slitter blade which forms one or more longitudinally extending slits completely through a comparatively wide web of paper thus forming two or more individual, narrower sections of paper. A spreader device, located downstream from the slitter blade, is effective to produce a longitudinally extending gap or space between the individual paper sections where the slits were formed. These separated paper sections are each transferred to an individual folding mechanism, each of which includes opposed knock-down fingers and opposed spirals, so that a zig-zag folded stack of individual sheets is formed from each paper section.

One important aspect of this invention is predicated upon the concept of effectively handling and supporting two or more comparatively narrow webs of paper formed by longitudinally slitting a wider web of paper. Instead of partially slitting the wide paper web, as in the prior art, the slitter(s) of this invention cut all the way through the wider web thus forming two or more completely separated longitudinally extending paper sections which are a half or a third as wide as the original paper web. Immediately after being slit, these sections of paper are advanced into contact with a spreader roller, which, in one embodiment, includes an outer surface formed with two or more sets of grooves oriented at diverging angles relative to one another. For example, if the wider paper web is slit into halves, one half of the outer surface of the spreader roller herein is formed with a first set of grooves angled in one direction, and the other half of the outer surface of the spreader roller is formed with a second set of grooves angled in a diverging or opposite direction from the first set. As a result, when the two sections of paper contact the spreader roller the two sets of angled grooves cause them to diverge from one another thus forming a longitudinally extending gap or space therebetween. This separation between the two sections of paper enables them to be transferred to their respective folding mechanisms, and then folded separately from one another, without interference or contact therebetween during the transfer and/or folding operations. Such separation between the two paper sections is particularly advantageous when handling comparatively light weight paper as opposed to heavier stock.

Another feature of this invention which aids in the folding operation is located between the folding mechanisms employed with each paper section. Assuming the wide web of paper is slit in half to form two paper sections, the two folding mechanisms used to fold the two paper sections are divided by a center support plate having an outwardly extending, horizontally oriented flange protruding from each side thereof. The purpose of this center support plate is to engage and support one side edge of each of the paper sections, e.g. the side edge formed by the slitter blade, in the course of the folding operation.

As mentioned above, in order to perform a folding operation, the paper sections are fed to a common swing chute which moves forwardly and rearwardly relative to a set of opposed knock-down fingers and a set of opposed spirals associated with each paper section. At the initial stages of the folding operation, wherein the knock-down fingers direct the paper sections to the spirals, each side edge of the separate paper sections must be horizontally supported. The flange carried by the center support plate provides this horizontal support for one side edge of each paper section, and the opposite side edge thereof is supported by a rotating, fluted roller of the type conventionally employed in zig-zag folding devices described above. Accordingly, both side edges of each paper section are maintained in a substantially horizontal orientation while they are handled by the opposed knock-down fingers and spirals so that a well-defined, uniform crease or fold can be formed along the perforations between adjacent sheets of each paper section.

The construction and method of operation of the apparatus herein therefore provides a substantial improvement over other folding devices. A wide web of paper can be cut into two or more narrower paper sections, each of which are independently folded and stacked without the need for manual separation of the individual stacks at some point downstream from the folding device. Because the individual paper sections are separated from one another, and then supported along both side edges in the course of the folding operation, jamming or other problems with the folding operation are substantially eliminated.

DESCRIPTION OF THE DRAWINGS

The structure operation and advantages of the presently preferred embodiment of this invention will become further apparent upon consideration of the following description, taken in conjunction with the accompanying drawings, wherein.

DETAILED DESCRIPTION OF THE INVENTION

Figure 1A:
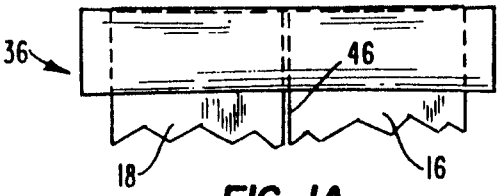
FIG. 1A is a cross sectional view taken generally along line 1A—1A of FIG. 1.

Referring now to the Figs., the folding apparatus 10 of this invention is particularly intended for use with paper webs 12 of indeterminate length having longitudinally spaced, transversely oriented perforations 13 which form individual sheets 14 therebetween. The apparatus 10 is operative to cut or slit the relatively wide paper web 12 into two or more paper sections, and then separately zig-zag fold the individual sheets in each of these paper sections into a stack. For purposes of the present discussion, the apparatus 10 is illustrated as slitting the paper web 12 in half thus forming two, side-by-side paper sections 16 and 18 which are subsequently folded into individual stacks 20 and 22, respectively, as described in detail below. It should be understood, however, that the paper web 12 could be slit into thirds, or even narrower sections of paper, depending upon the requirements of a particular application and the overall width of the paper web 12.

Figure 1:
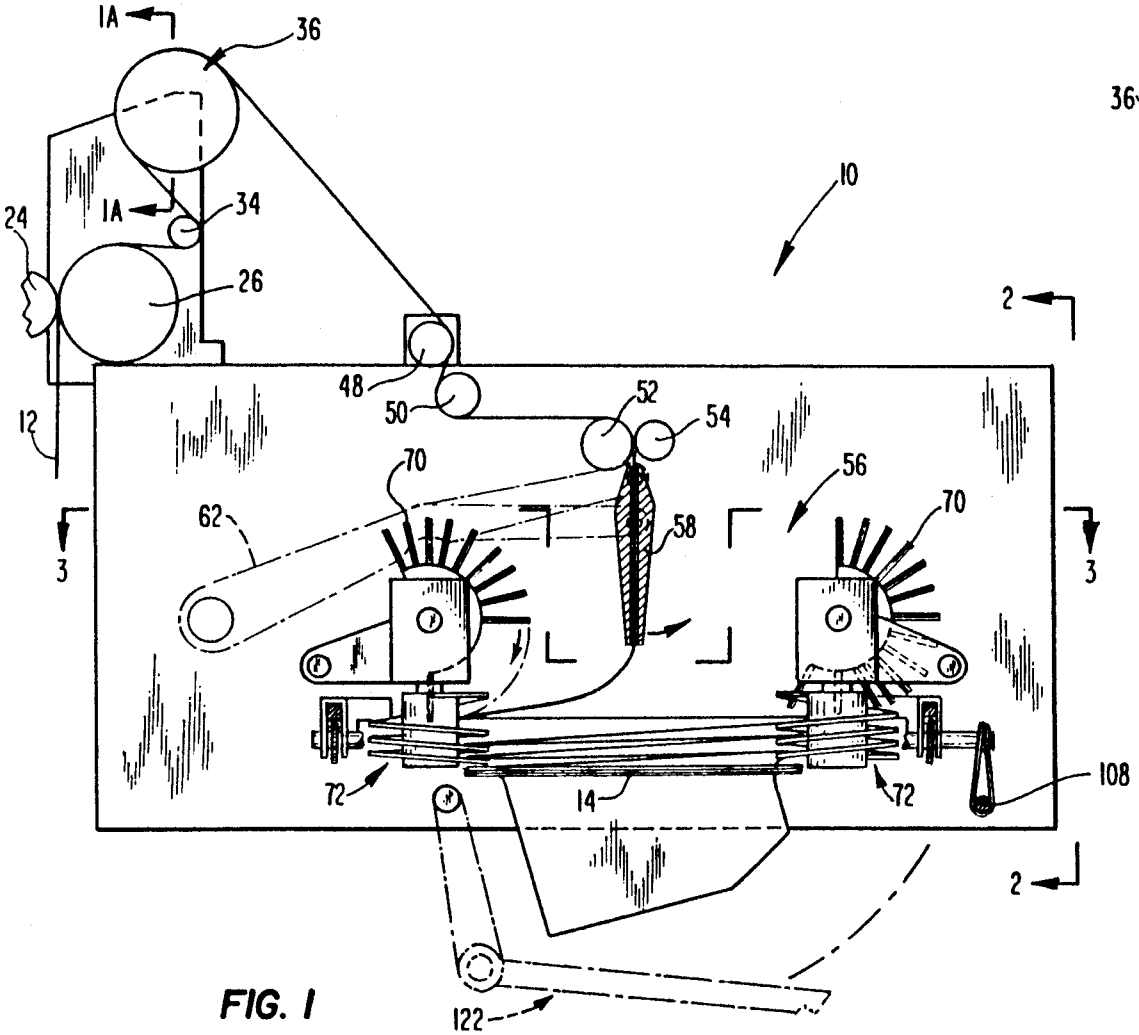
FIG. 1 is a schematic, side view of the folding apparatus of this invention including the slitter blade and spreader roller.
Figure 3:
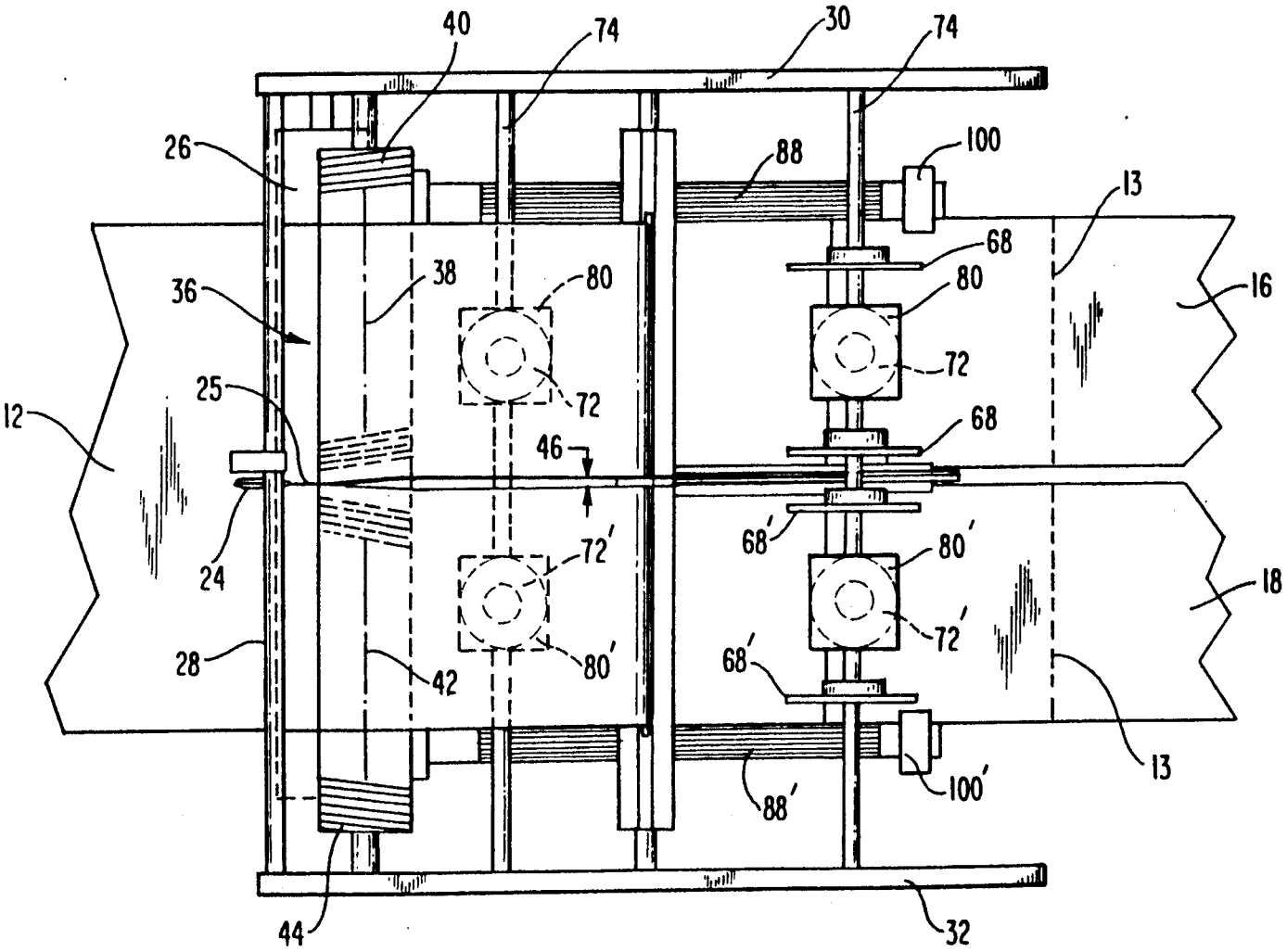
FIG. 3 is a top view of a portion of the folding apparatus taken generally along line 3—3 of FIG. 1.

As depicted schematically at the left hand side of FIG. 1, and in FIG. 3, the paper web 12 is fed from a high speed printer (not shown) in between a slitter blade 24 and an anvil roller 26. The slitter blade 24 is adjustably carried on a rod 28 extending between the frame sidewalls 30 and 32 of folding apparatus 10. Similarly, the anvil roller 26 is journalled at each end to the frame sidewalls 30, 32 and is freely rotatable with respect to the slitter blade 24. As depicted in FIGS. 1 and 3, the slitter blade 24 forms a longitudinally extending slit 25 in paper web 12, which extends all the way through such web 12, thus forming the discrete paper sections 16 and 18 each having a width equal to one-half of the width of the paper web 12.

The two paper sections 16 and 18 are looped around a tension roller 34, where they are retained in side-by-side relation, and then wrapped around a spreader roller 36 whose ends are journalled to the frame sidewalls 30, 32 so that the spreader roller 36 is freely rotatable. In the embodiment of this invention wherein two paper sections 16 and 18 are formed, the outer surface of the spreader roller 36 is formed with a first set of angled channels or grooves 38 extending from the center of spreader roller 36 to its end 40, and a second set of angled grooves 42 which extend from the roller center to the opposite end 44 thereof. Preferably, the outer surface of spreader roller 36 is formed of a slip-resistant, cushioning material. As best shown in FIG. 3, the sets of grooves 38 and 42 are angled away from one another, i.e. they diverge, such that when the paper sections 16 and 18 engage the grooves 38, 42, respectively, the paper sections 16, 18 move away or diverge from one another along the spreader roller 36. This is because the angulation of the grooves 38 on the outer surface of spreader roller 36 move paper section 16 toward its end 40, whereas the set of grooves 42 move paper section 18 toward its opposite end 44. As a result, a longitudinally extending space or gap 46 is formed between the paper sections 16, 18 which facilitates handling of such sections 16, 18 individually, as described below.

The paper sections 16, 18 are moved in tandem from the spreader roller 36 to a pair or compensator rollers 48 and 50 and then between the nip of a pull roller 52 and gripper roller 54. The purpose of the compensator rollers 48, 50 is to maintain proper adjustment of the position of the perforations 13 along the paper sections 16, 18 upstream from the pull roller 52 and the folding mechanisms described in detail below.

Figure 4:
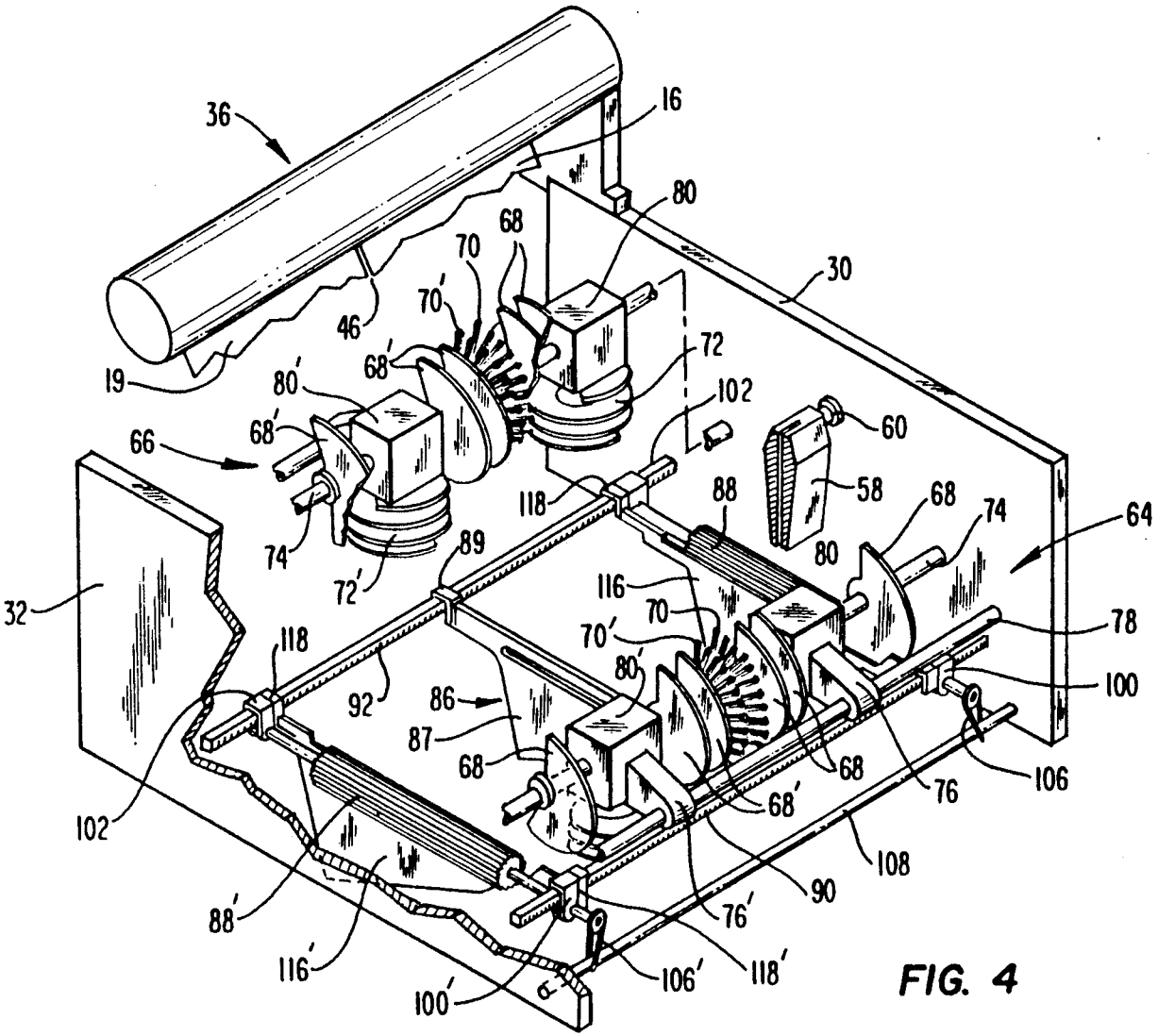
FIG. 4 is a schematic, partially disassembled view of one side of the folding apparatus of this invention.

Referring to FIGS. 1 and 4, the paper section 16 is fed from between pull roller 52 and gripper roller 54 to a single swing chute 58 rotatably mounted by rods 60 to the frame sidewall 30. The swing chute 58 is moved in a forward and rearward direction by a swing chute drive arm 62 shown schematically in FIG. 1. The detailed construction and operation of swing chute 58 and drive arm 62 forms no part of this invention, and reference should be made to U.S. Pat. No. 5,084,000 for a detailed discussion of same, the disclosure of which is incorporated by reference in its entirety herein. The term "forward" as used herein is meant to refer to the righthand side of apparatus 10 as depicted in FIGS. 1 and 4, whereas "rearward" is meant to refer to the opposite direction. The "throw" or forward-to-rearward movement of the swing chute 58 is chosen in proportion to the longitudinal spacing between the transversely oriented perforations along paper section 16.

Each of the paper sections 16 and 18 is directed by the swing chute 58 to an individual folding assembly 56 which is operative to form the individual stacks 20 and 22 mentioned above. For ease of illustration and description, the detailed construction of only one of the folding assemblies 56 is provided herein which is utilized to fold paper section 16, it being understood that the identical structure is provided for handling paper section 18. The structure illustrated in the Figs. for handling paper section 18 which is common to that of folding assembly 56 is depicted with the same reference numerals as folding assembly 56, with the addition of a prime thereto.

The folding assembly 56 comprises forward folding station 64 and a rearward folding station 66 which are located forwardly and rearwardly of the swing chute 58, respectively. Each of the forward and rearward folding stations 64, 66 include identical structure for forming a fold or crease along the perforation 13 between adjacent sheets 14 within paper section 16. This folding structure includes a series of knock-down fingers 68, a brush 70 and a spiral 72. The knock-down fingers 68 and brush 70 at each of the forward and rearward folding stations 64 and 66 are fixed on a rotating shaft 74 which extends between the frame sidewalls 30, 32 and is drivingly connected to a main drive train (not shown) associated with the folding apparatus 10. The spiral 72 is carried by a mounting block 76 slideable along a mounting rod 78 extending between the frame side walls 30, 32, and this mounting block 78 carries a gear box 80 drivingly connected to the rotating shaft 74. The gear box 80 has an output shaft 82 which is drivingly connected to the spiral 84 so that the spiral 84 rotates in timed relation to the rotation of shaft 74. As mentioned above, both of the forward and rearward folding stations 64 and 66 have the identical folding apparatus except that the shaft 74' of rearward folding station 66 rotates in the opposite direction from that of shaft 74. Moreover, the same construction of the forward and rearward folding stations 64, 66 is employed on the side of apparatus 10 which folds the paper section 18.

Figure 2A:
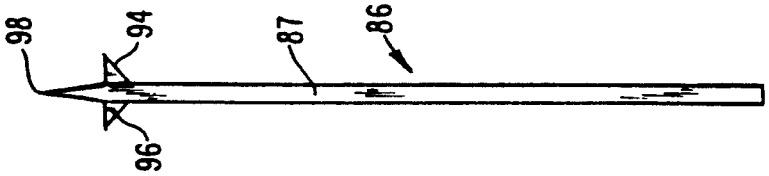
FIG. 2A is an enlarged view of the center support plate herein.
Figure 2:
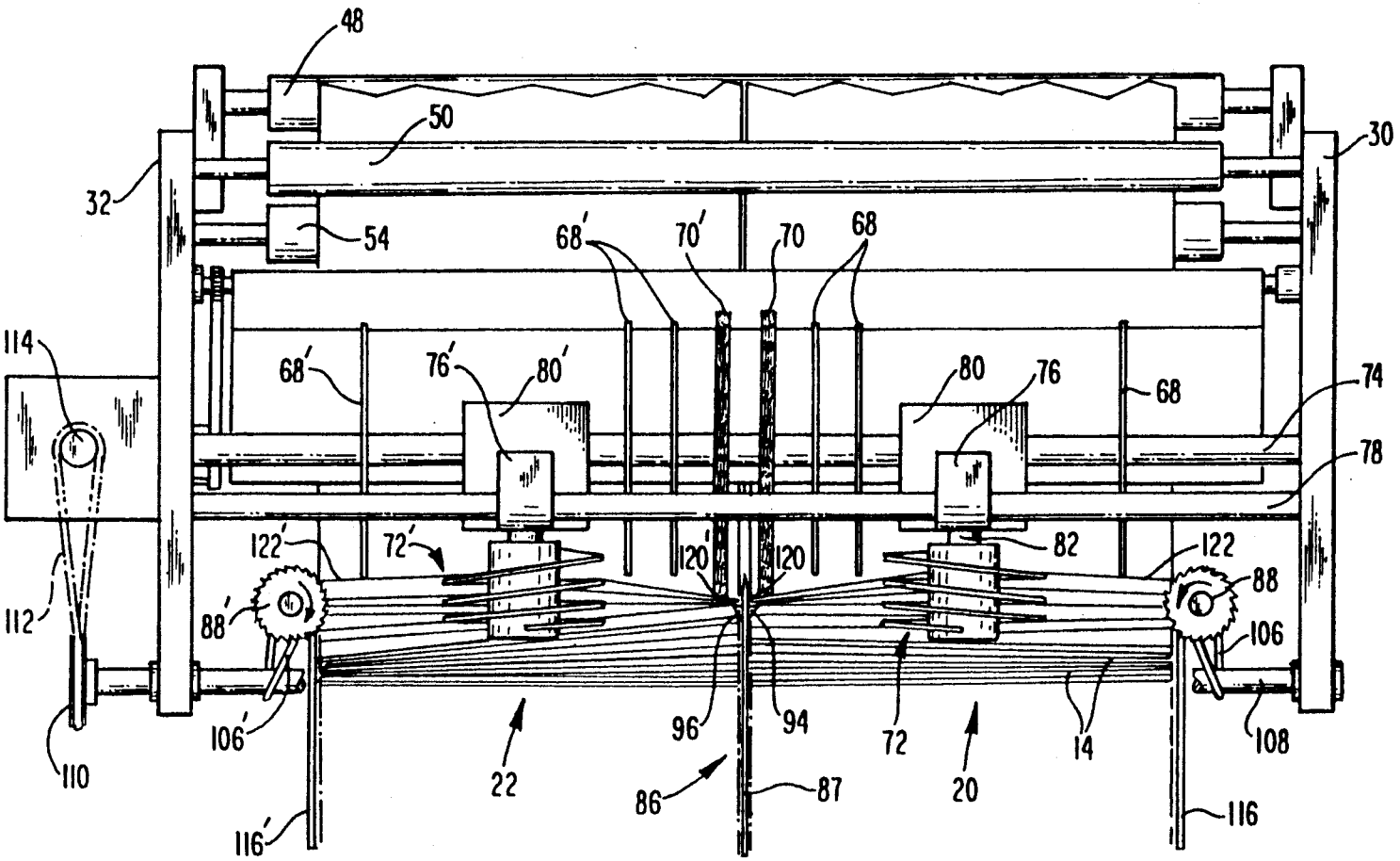
FIG. 2 is an end view of the discharge end of the folding apparatus taken generally along line 2—2 of FIG. 1.

One important aspect of this invention is the provision of structure for supporting the side edges of paper section 16 as it is transmitted by the swing chute 58 to each of the forward and rearward folding stations 64, 66. As best shown in FIGS. 2, 2A and 4, this support structure includes a center support 86 and a fluted roller 88 located adjacent the frame sidewall 30. In the presently preferred embodiment, the center support 86 is an elongated, vertically oriented plate 87 which extends longitudinally between the forward and rearward folding stations 64 and 66 and is mounted at opposite ends by a bracket 89 to a forward rack 90 and a rearward rack 92. See also FIG. 4. Preferably, the center support 86 is formed with a pair of horizontally oriented flanges 94 and 96 which extend outwardly from opposite sides of the vertical plate 87 thereof. Flange 94 faces the fluted roller 88, whereas flange 96 faces the fluted roller 88, associated with the folding structure for paper section 18. As described in more detail below, each flange 94 and 96 supports one side edge of the paper sections 16 and 18, respectively, as they are transmitted to the forward and rearward folding stations 64, 66 for folding. In the presently preferred embodiment, the width of the vertical plate 87 is approximately 0.135 inches, each horizontally oriented flange 94, 96 projects approximately 0.080 inches from the vertical plate 87 and the vertical distance between the flanges 94, 96 and the top 98 of center support 86 is preferably about 0.250 inches.

With reference to FIG. 4, the opposite ends of each of the fluted rollers 88 and 88' are rotatably mounted in a bearing (not shown) carried by opposed brackets 100 and 102 on the forward and rearward racks 90, 92, respectively. These brackets 100, 102 are adjustable in a side-to-side direction along racks 90, 92 by rotation of pinion gears (not shown) mounted at each end of rollers 88, 88' which are mateable with the teeth on the forward and rearward racks 90, 92. This rack-and-pinion connection permits adjustment of the lateral position of each fluted roller 88, 88' with respect to the center support 86. One end of fluted roller 88 mounts a pulley 104 which is drivingly connected by a belt 106 to a rod 108. As shown in FIG. 2, the rod 108, in turn, carries a pulley 110 which is connected by a belt 112 to a shaft 114 rotated by the main drive of the apparatus 10 in a manner not shown.

Additionally, as best seen in FIG. 4, a side plate 116 is mounted by opposed brackets 118 to the forward and rearward racks 90, 92 immediately beneath the fluted roller 98 and substantially parallel to the center support 86. A similar side plate 116' is mounted by brackets 118' on the opposite side of apparatus 10, beneath the fluted roller 88'. These side plates 116, 116' assist in guiding the folded sheets from paper sections 16, 18, as described below.

METHOD OF OPERATION

The operation of apparatus 10 in first forming individual paper sections 16 and 18, and then individually stacking them, proceeds as follows. As noted above, the paper web 12 is initially advanced in between the slitter blade 24 and anvil roller 26 from a high speed printer (not shown). The slitter blade 24 is operative to form a longitudinally extending cut or slit 25 completely through the paper web 12 to cut it in half thus forming two individual, longitudinally extending paper sections 16 and 18. As mentioned above, more than one slitter blade 24 could be employed to form additional paper sections from the web 12 depending upon the requirements of a particular application and the overall width of web 12.

After leaving the slitter blade 24, the paper sections 16 and 18 are separate but located immediately adjacent, i.e. side-by-side, one another. In order to avoid interference therebetween, and facilitate folding downstream from the slitter blade 24, the spreader roller 36 is employed to form a longitudinally extending space or gap 46 between the paper sections 16, 18. As mentioned above, when the paper sections 16 and 18 contact the divergingly angled sets of grooves 38 and 42, respectively, the paper section 16 is urged toward the end 40 of the spreader roller 36 while the paper section 18 is urged toward the opposite end 44 of spreader roller 36. As a result, the longitudinal gap 46 is formed therebetween (see FIG. 3). With this separation between paper sections 16 and 18, the folding operation for each of the paper sections 16, 18 can proceed without interference or jamming. In addition to the separation provided by spreader roller 36, the vertical plate 87 of center support 86 is effective to separate the paper sections 16, 18 as they are fed to the folding stations 64, 66 for folding.

It has been found that in order to efficiently fold each of the paper sections 16, 18, their side edges must be horizontally supported as the creases or folds are formed along the perforations between adjacent sheets in said sections 16, 18. With particular reference to the paper section 16, the swing chute 58 moves the paper section 16 forwardly and rearwardly relative to the forward and rearward folding stations 64 and 66. In the course of movement between the folding stations 64, 66, the swing chute 58 places the paper section 16 in position to contact the knock-down fingers 68 at each station 64, 66 which direct the paper section 16 into contact with the forward and rearward spirals 72. In order to maintain proper alignment with the spirals 72, and thus ensure a uniform fold or crease is formed along the perforation between adjacent sheets within paper section 16, the horizontally extending flange 94 of center support 86 supports one side edge 120 of paper section 16 while the fluted roller 88 supports the opposite side edge 122 of paper section 16. See FIG. 2. Additionally, the brushes 70, located at each of the forward and rearward folding stations 64 and 66, urge the paper section 16 into position against the flange 94 so that substantially horizontal orientation of the paper is maintained. If not for the presence of center support 86, the side edge 120 of the paper section 16 would be angled downwardly with respect to the spiral 72 which could result in disengagement of the paper therefrom and, hence, the formation of an improper or incomplete fold. Movement of the paper section 16 from the flange 94 or center support 86 is obtained by a rotation of the spiral 72, rotation of the fluted roller 88, and rotation of the brushes 70 so that adjacent sheets 14 of paper section 16 are stacked in zig-zag fashion atop one another forming a stack 20 beneath the spirals 84 on a ramp 122 depicted schematically in FIG. 1. The sheets 14 forming stack 20 are guided and transferred in a vertically downward direction from flange 94 and fluted roller 88 by the vertical plate 87 of center support 86 and the side plate 116 below the fluted roller 88.

As noted above, the folding structure associated with the paper section 18 is identical to that described in connection with paper section 16 and functions in the same manner. The side edges 120' and 122' of paper section 18 are similarly supported by the fluted roller 88' and the opposite flange 96 of center support 86 and then such side edges 120', 122' follow the vertical plate 87 of center support 86 and the side plate 116'. Because the paper sections 16 and 18 are separated from one another by the longitudinally extending gap 46 upstream from the folding devices described above, the paper sections 16, 18 are deposited on opposite sides of the vertical plate 87 of center support 86 and into the proper horizontal position with respect to their associated knock-down fingers 68, 68', brushes 70, 70' and spirals 72, 72'. As a result, two independently folded and completely separated stacks 20 and 22 of zig-zag folded sheets 14 are formed by the apparatus 10 of this invention.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Figure 5:
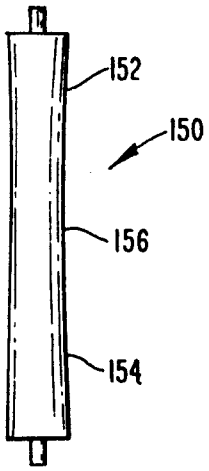
FIG. 5 is a schematic view of an alternative embodiment of a spreader roller.

For example, as noted above, the apparatus 10 is illustrated as including structure for handling two paper sections 16, 18 formed from web 12. It should be understood that the web 12 could be cut or slit into three or more sections, for example, with the addition of an additional slitter blade(s) 24, the inclusion of three or more sets of grooves along spreader roller 36 and the addition of a separate folding device for each paper section Additionally, it should be understood that different configurations of a spreader roller could be employed to obtain separation between paper sections 16, 18 along the slit 25 therebetween. As described above, the spreader roller 36 employs two or more sets of divergingly angled grooves 38, 42 which contact and urge the paper sections 16, 18 apart as described above. Alternatively, a spreader roller 150 shown in FIG. 5 could be used to obtain the space or gap 46 between paper sections 16, 18. As depicted in FIG. 5, spreader roller 150 has a "reverse crown" outer surface in which opposed ends 152 and 154 angle inwardly to the center 156 where the diameter of the spreader roller 150 is smallest. It is contemplated that with either spreader roller 36 or 150, a separation between adjacent paper sections 16, 18 is most important with light weight paper webs 12 as compared to heavier paper stock. In any case, the vertical plate 87 of the center support 86 also assists in obtaining separation between the paper sections 16, 18 at the folding area to ensure there is no interference therebetween in the course of the folding operation.

Therefore, it is intended that the invention not be limited to the particular embodiment disclosed as the best mode contemplated for carrying out this invention, but that the invention will include all embodiments falling within the scope of the appended claims.

I claim:

1. Apparatus for zig-zag folding a web of paper having longitudinally spaced, transverse perforations, comprising:

cutter means for cutting the web of paper longitudinally to form at least two side-by-side, longitudinally extending sections of paper;

spreader means, located downstream from said cutter means, for moving said paper sections apart to form a longitudinally extending gap therebetween;

folding means for folding each of said paper sections into a separate stack of zig-zag folded sheets.

2. The apparatus of claim 1 in which said spreader means is a roller having opposed ends and an outer surface engageable with said paper sections, said outer surface being formed with at least one set of grooves angled in a direction toward one of said opposed ends and at least one other set of grooves angled in a direction toward the other of said opposed ends.

3. The apparatus of claim 2 in which one of said paper sections contacts said one set of grooves and the other of said paper sections contacts said other set of grooves, said angulation of said sets of grooves causing said paper sections to diverge from one another forming said longitudinally extending gap therebetween.

4. The apparatus of claim 1 in which said spreader means is a roller having opposed ends and an outer surface engageable with said paper sections, said outer surface tapering radially inwardly from each of said opposed ends toward the center of said roller.

5. The apparatus of claim 1 in which said spreader means is a vertical plate positioned in alignment with the longitudinally extending cut between said sections of paper so that said sections of paper are longitudinally separated from one another for folding by said folding means.

6. The apparatus of claim 1 in which said cutter means comprises a cutting member which is effective to cut completely through the web of paper longitudinally, and form said at least two discrete longitudinally extending sections of paper.

7. The apparatus of claim in which said folding means includes a separate folding device for each of said sections of paper, each of such folding devices comprising:

longitudinally spaced, first and second folding stations;

a spiral located at each of said first and second folding stations which is effective to fold one section of paper along the longitudinally spaced perforations thereof to form zig-zag folded sheets;

support means for supporting each side edge of said one section of paper in the course of forming said zig-zag folded sheets.

8. The apparatus of claim 7 in which said support means comprises:

a fluted roller located along one side of said one section of paper and engageable with a side edge thereof, said fluted roller being rotatable to move said one section of paper downwardly in a direction substantially perpendicular to the longitudinal direction of movement of said sections of paper;

a support plate having an outwardly extending flange positioned to support the other side edge of said one section of paper.

9. The apparatus of claim 8 in which the web of paper is slit in half to form two longitudinally extending sections of paper, said support plate being positioned in between said two paper sections and being formed with a first flange portion engageable with a side edge of one of said paper sections and a second flange portion engageable with a side edge of the other of said paper sections.

10. The apparatus of claim 9 in which said support plate has a width of about 0.135 inches measured perpendicularly to the direction of movement of said paper section, and each of said first and second flange portions projects about 0.080 inches from said support plate.

11. Apparatus for zig-zag folding a web of paper having longitudinally spaced, transverse perforations, comprising:

cutter means for cutting the web of paper longitudinally to form at least two side-by-side, longitudinally extending sections of paper;

spreader means, located downstream from said cutter means, for moving said paper sections apart to form a longitudinally extending gap therebetween;

folding means, associated with each of paper sections, for folding said paper sections into separate stacks of zig-zag folded sheets, each of said folding means including:

(i) longitudinally spaced, first and second folding stations;

(ii) a spiral located at each of said first and second folding stations which is effective to fold one section of paper along the longitudinally spaced perforations thereof to form zig-zag folded sheets;

(iii) support means for supporting each side edge of said one section of paper in the course of forming said zig-zag folded sheets.

12. The apparatus of claim 8 in which said support means comprises:

a fluted roller located along one side of said one section of paper and engageable with a side edge thereof, said fluted roller being rotatable to move said one section of paper downwardly in a direction substantially perpendicular to the longitudinal direction of movement of said paper sections;

a support plate having an outwardly extending flange positioned to support the other side edge of said one section of paper.

13. The apparatus of claim 9 in which the web of paper is slit in half to form two longitudinally extending sections of paper, said support plate being positioned in between said two paper sections and being formed with a first flange portion engageable with a side edge of one of said paper sections and a second flange portion engageable with a side edge of the other of said paper sections.

14. The apparatus of claim 13 in which said support plate has a width of about 0.135 inches measured perpendicularly to the direction of movement of said paper section, and each of said first and second flange portions projects about 0.080 inches from said support plate.

15. The apparatus of claim 11 in which said spreader means is a roller having opposed ends and an outer surface engageable with said paper sections, said outer surface being formed with at least one set of grooves angled in a direction toward one of said opposed ends and at least one other set of grooves angled in a direction toward the other of said opposed ends.

16. The apparatus of claim 15 in which one of said paper sections contacts said one set of grooves and the other of said paper sections contacts said other set of grooves, said angulation of said sets of grooves causing said paper sections to diverge from one another forming said longitudinally extending gap therebetween.

17. The apparatus of claim 11 in which said spreader means is a roller having opposed ends and an outer surface engageable with said paper sections, said outer surface tapering radially inwardly from each of said opposed ends toward the center of said roller.

18. The apparatus of claim 11 in which said spreader means is a vertical plate positioned in alignment with the longitudinally extending cut between said sections of paper so that said sections of paper are longitudinally separated from one another for folding by said folding means.

19. A method of zig-zag folding a web of paper having longitudinally spaced, transverse perforations, comprising:

cutting the web of paper to form at least two side-by-side, longitudinally extending sections of paper;

separating the sections of paper to form a longitudinally extending space therebetween;

folding each of said sections of paper to form at least two stacks of zig-zag folded sheets.

20. The method of claim 19 in which said step of folding each of said sections of paper includes supporting both side edges of each section of paper in the course of forming the stacks of zig-zag folded sheets.

21. The method of claim 19 in which said step of cutting the web of paper comprises cutting entirely through the web of paper to form at least two separate longitudinally extending sections of paper.

22. The method of claim 19 in which said step of separating the sections of paper comprises directing the sections of paper into contact with a spreader roller formed with divergingly angled sets of grooves on the exterior surface thereof so that upon contact with said grooves the paper sections diverge from one another to form a longitudinally extending gap therebetween.

23. The method of claim 19 in which said step of separating the sections of paper comprises directing the sections of paper into contact with a spreader roller formed with an outer surface which tapers radially inwardly from the opposed ends thereof toward the center.

24. The method of claim 19 in which said step of separating the sections of paper comprises directing the sections of paper to a vertical plate positioned in alignment with the longitudinally extending cut therebetween.

25. A method of zig-zag folding a web of paper having longitudinally spaced, transverse perforations, comprising:

cutting the web of paper to form at least two side-by-side, longitudinally extending sections of paper;

separating the sections of paper to form a longitudinally extending space therebetween;

supporting the side edges of each of the sections of paper; and folding each of said sections of paper to form at least two stacks of zig-zag folded sheets.

* * * * *